US012557882B2

(12) United States Patent
Lin et al.

(10) Patent No.: US 12,557,882 B2
(45) Date of Patent: Feb. 24, 2026

(54) CONTINUOUS POLARIZATION ADHESIVE BONDING AND TRANSMISSION APPARATUS FOR SHOEMAKING

(71) Applicant: LAYA CHEMICAL ENGINEERING CO., LTD., Douliu (TW)

(72) Inventors: Wen-Chih Lin, Douliu (TW); Li-Yung Hsu, Taichung (TW)

(73) Assignee: LAYA TECHNOLOGY CO., LTD., Yunlin County (TW)

( * ) Notice: Subject to any disclaimer, the term of this patent is extended or adjusted under 35 U.S.C. 154(b) by 105 days.

(21) Appl. No.: 18/422,592

(22) Filed: Jan. 25, 2024

(65) Prior Publication Data

US 2025/0241414 A1 Jul. 31, 2025

(51) Int. Cl.
*A43D 25/20* (2006.01)
*A43D 25/18* (2006.01)

(52) U.S. Cl.
CPC ..... *A43D 25/20* (2013.01); *A43D 25/18* (2013.01)

(58) Field of Classification Search
CPC ..... A43D 25/20; A43D 25/18; A43D 95/10; H05B 6/78; H05B 6/782; H05B 6/76; B29C 35/0277; B29C 65/1425
USPC ..... 156/380.9, 499; 210/699, 738
See application file for complete search history.

(56) References Cited

U.S. PATENT DOCUMENTS 3,151,230 A * 9/1964 Britton ..... H05B 6/76 219/699
4,227,063 A * 10/1980 Edgar ..... H05B 6/76 219/699

* cited by examiner

*Primary Examiner* — John L Goff, II
(74) *Attorney, Agent, or Firm* — BACON & THOMAS, PLLC

(57) ABSTRACT

The present invention relates to a continuous polarization adhesive bonding and transmission apparatus for shoemaking. A polarizing device is provided inside a polarization chamber, and a conveyor belt capable of conveying materials is provided below said polarization chamber. The entrance side and the exit side of said polarization channel is respectively provided with a wave blocking tunnel, and said conveyor belt is installed through said wave blocking tunnel. The conveyor belt is provided with spaced electromagnetic protection plates, and the material to be polarized is provided between the two electro magnetic protection plates. When the material conveyed by the conveyor belt is polarized through the polarization chamber, the spaced electromagnetic protection plates can prevent the leakage of polarized waves.

14 Claims, 12 Drawing Sheets

CONTINUOUS POLARIZATION ADHESIVE BONDING AND TRANSMISSION APPARATUS FOR SHOEMAKING

BACKGROUND OF THE INVENTION

Field of the Invention

The present invention relates to a transmission apparatus, in particular to a conveyor belt for transporting shoe bodies to a polarization chamber for polarization treatment is provided with a plurality of spaced electromagnetic protection plates, thus when the polarization apparatus is provided to conduct polarization on the passing shoe bodies, the continuous polarization adhesive bonding and transmission device for shoemaking shall avoid leakage of polarization waves during polarization treatment.

Description of Related Art

Shoes are items used by humans to protect their feet. As shown in FIG. 1A, shoes mainly include two parts: the vamp 11 and the sole 12. In practice, as shown in FIG. 1B, the exposed sole 12 is also called the outsole. There is a midsole 13 between the bottom of the vamp 11 and the sole 12, and the vamp 11 is adhered by the midsole 13 on the upper surface of the sole 12 to form an integral shoe. In the early days, the soles and vamps of shoes were mostly glued together by artificial works. However, manual gluing was not only labor-intensive but also the glue to overflow and cause defects of the shoes easily cause. Later, with the development of industry, mechanical equipment was used to wipe glue, spray glue, apply glue or brush glue etc., However, since the shoe body undergoes gluing, gluing and other processes that take a long time, it is not advantageous to rapid production. Currently, some manufacturers have developed polarization devices to polarize the shoe bodies to achieve rapid and stable adhesions between the sole and the vamp.

The so-called polarization treatment is to use microwave energy with short t wavelength (1 m~1 mm), high frequency (between 300 MHZ~300 GHZ), and the basic properties of microwave are usually penetration, reflection, and absorption. By continuously applying the materials fed into the chamber to be heated by absorbing microwaves, so a continuous microwave heating system with openings is required. However, if there is no structure to suppress microwaves at the input and output openings, microwaves will leak at the entrance and exit, and will be absorbed by the human, as a result, causing harm to the human body. This is because the ability of a substance to absorb microwaves is mainly determined by its dielectric loss factor. The greater of the fact regarding the dielectric loss factor of a material, the stronger its ability to absorb microwaves, and vice versa. Since each substance has different dielectric loss factors, microwave heating also exhibits the characteristics of optional heating. For example, water molecules are polar molecules with large dielectric constants and large dielectric loss factors, and have strong absorption capabilities for microwaves; while the other substances with smaller dielectric constants have poor absorption capabilities for microwaves. Because it is small, it is well known that the human body has an extremely high proportion of water.

The current polarization chambers with continuous openings mostly use conductive materials such as metal, graphite, carbon, etc. with suppression structures around the chamber tunnel opening. If the material that needs to be heated by microwave is larger, the height of the chamber tunnel opening will be higher, resulting in the distance between the center of the material and the microwave suppression structure is longer. Therefore, the effect of strengthening the suppression structure of the tunnel will be limited. Materials generally used to suppress microwaves can be graphite, graphene, metal, carbon and its allotropes, titanium metal or conductive graphite composite materials. The shape can be rectangular, circular or irregular to suppress microwaves, so as to be attenuated and absorbed after it passes the tunnel. However, as mentioned above, when the material that requires larger microwaves, the microwave suppression structure is further away from the center of the material. No matter how to enhance the microwave absorption capacity of the microwave suppression material, its suppression effect will still decrease exponentially, or it will need to be exponentially eliminated. By restricting the lengthen of the microwave suppression tunnel shall cause natural decay of microwaves, but its length will increase as the microwave power increases, and may be as long as more than 10 meters.

Please refer to FIG. 2, which is a schematic diagram of a conventional electromagnetic polarization machine production line. The electromagnetic polarization machine production line 100 is provided with a polarization device 120 inside a polarization chamber 110. The polarization device 120 can emit polarization waves to polarize the shoe body 10 (including the sole and the vamp) passing through the polarization chamber to accelerate the adhesion of the sole and the vamp. A conveyor belt 130 is provided below the polarization chamber 110. The conveyor belt 130 is mainly used to carry the shoe body 10 through the polarization chamber 110 and transport the polarized shoe body 10 to the back-end operation stage.

In order to avoid excessive leakage of the polarization wave of the polarization chamber (generally required to comply with the international standard value of 5 mW/cm2), the electromagnetic polarization machine production line 100 has a special configuration on the entry side and exit side of the polarization chamber 110 (i.e. the front section and the rear section of the conveyor belt 130 are respectively provided with a wave-blocking tunnel 140 and 150, and the conveyor belt 130 runs through the wave-blocking tunnels 140 and 150. The wave blocking tunnels 140 and 150 are arranged inside a tubular channel with a plurality of carbon fiber cloths 160 spaced apart. Each carbon fiber cloth 160 is provided between two shoe bodies 10 so that before or after the conveyor belt 120 carries the shoe bodies 10 through the polarization chamber 110, a plurality of spaced carbon fiber cloths 160 can be used to prevent polarization waves from leaking out.

The above-mentioned electromagnetic polarization machine production line 100, taking the length of the polarization chamber as 1 meter and the polarization time as 20 seconds as an example, can complete the polarization treatment of approximately 3.75 pairs of shoes per minute. However, since the carbon fiber cover 160 is only fixed on the top of the wave blocking tunnels 140 and 150 with its upper end, when a plurality of spaced shoe bodies 10 pass through the lower end of the carbon fiber cover 160, the lower end of the carbon fiber cover 160 will be lifted up, which causes the leaking of polarization waves and harm to operators.

Please refer to FIG. 3, which is a schematic diagram of another conventional electromagnetic polarization machine production line. The electromagnetic polarization machine production line 200 is also provided with a conveyor belt 220 below the polarization chamber 210. The belt 220 carries the shoe body 10 through the polarization chamber 210, and then transports the polarized shoe body 10 to the back-end operation. The difference between this electromagnetic polarization machine production line 200 and the previous electromagnetic polarization machine production line 100 is that the entry and exit sides of the polarization chamber 210 of this electromagnetic polarization machine production line 200 are respectively provided with a rapid rise and fall of air pressure blocking wave gates 230 and 240. When the shoe body 10 is carried into the polarization chamber 210, the front air pressure rises and falls rapidly, the wave blocking gate 230 opens. When the shoe body 10 enters the polarization chamber 210, the front air pressure rises and falls rapidly. While the wave blocking gate 230 is closed, when the shoe body 10 completes the polarization process and leaves the polarization chamber 210, the rear air pressure rapidly rises and falls and the wave blocking gate 240 opens. After the shoe body 10 leaves the polarization chamber 210, the rear air pressure rises and falls rapidly and the wave blocking gate 240 closes again. Accordingly, the leakage of polarized waves is avoided by opening and closing the two gates. Since it is a batch process, taking the polarization chamber length as 1 meter and the polarization time as 20 seconds as an example, approximately 4.5 pairs of shoes can be polarized per minute. However, each batch of multiple pairs of shoe bodies requires more operators to disassemble the clamps after discharging, which will increase the cost burden and is an expected result.

Please refer to FIG. 4, which is a schematic diagram of another conventional electromagnetic polarization machine production line. The electromagnetic polarization machine production line 300 is also provided with an entry side and an exit side of the polarizing chamber 310. The wave-blocking tunnels 320 and 330 are penetrated by the conveyor belt 340. The shoe bodies 10 on the conveyor belt 340 are arranged in sequence without intervals. It is a continuous polarization process with advantage of large production capacity. It can complete the polarization treatment of approximately 7.5 pairs of shoes per minute, but because it is a slow-speed shoe entry (polarization time 20 seconds, line speed 3 meters/min) and fast shoe-out (de-orbit time 6 seconds, production line speed 50 meters/min) design, a soft baffle 350 has to be installed at the rear end of the conveyor belt 340, and the speed of the discharge track is faster than the speed of the feed track, which easily causes the problem of high-speed sliding of the clamp when the shoe body is discharged.

In view of the above, the inventor relied on the manufacturing experience and technology accumulation of various shoes to research and improve the above-mentioned shortcomings. After continuous research and experimental improvements, the continuous polarized adhesive lamination and transmission device for shoemaking of the present invention has developed, which is expected to eliminate the shortcomings and deficiencies caused by conventional shoemaking factories.

SUMMARY OF THE INVENTION

Therefore, the present invention is objected to provide an apparatus of continuous polarization adhesive bonding and transmission apparatus for shoemaking, which enables the adhesion of the sole and vamp of the shoe material to be completed through the polarization treatment of the polarization apparatus.

According to the continuous polarization adhesive bonding and transmission apparatus for shoemaking of the present invention, a conveyor belt that can transport the shoe body is provided. The conveyor belt carries the shoe body through a polarization chamber, so that the shoe body is subjected to polarization treatment in the chamber. The conveyor belt is also provided with spaced upright electromagnetic protection plates, and the shoe body is arranged between the two upright electromagnetic protection plates. Such that when the conveyor belt transports the shoe body through the polarization when the chamber is undergoing polarization treatment, the upright electromagnetic protection plate can be fixed on the conveyor belt to avoid excessive leakage of polarization waves from the polarization apparatus, this is the second object of the present invention.

According to the continuous polarization adhesive bonding and transmission apparatus for shoemaking of the present invention, the said electromagnetic protective plate can advance along with the material and block microwaves. As long as the size of the electromagnetic protective plate increases as the material increases, the increase size of materials and the size of the opening of the microwave oven without changing the microwave suppression structure of the chamber and the length of the chamber tunnel will be done, this is another object of the present invention.

According to the continuously polarization adhesive bonding and transmission apparatus for shoemaking of the present invention, in order to further prevent the electromagnetic protective plate from entering the microwave chamber in the rising state and affecting the distribution of microwaves in the chamber, the electromagnetic protective plate is set as a domino, this domino type electromagnetic protection plate rises before entering the tunnel entrance, descends before entering the microwave chamber, and rises again before leaving the microwave chamber to prevent the dispersion of microwaves. This is also another object of the present invention.

According to the continuous polarization adhesive bonding and transmission apparatus for shoemaking of the present invention, wave reduction columns arranged in metal cylinders are further provided on the gap between the tunnel chamber wall and the electromagnetic protection plate, this is another object of the present invention.

According to the continuous polarization adhesive bonding and transmission apparatus for shoemaking of the present invention, the wave reduction column and the electromagnetic protective plate can further consider the shielding effect. The shielding effect is generally called "static electricity" shielding effect, and it is also effective for electromagnetic waves. And the skin effect and skin depth must be considered. That is to say, when an electromagnetic wave hits a metal plate, most of the energy is reflected, and a small part of the energy enters the metal. The intensity of the electromagnetic wave will decay exponentially with the depth of entering the metal (converted into a current inside the metal). When the metal layer is too thin, the electromagnetic waves will penetrate the metal layer and continue to propagate. For the same metal material, the higher the frequency of the electromagnetic wave, the faster it attenuates. For the wave of 2.45 GHz used in microwave ovens, the skin depth of metallic iron is less than 1 micron, so the metal thickness of the chamber wall and electromagnetic protection plate needs to be greater than 1 micron, and the metal aperture only needs to be less than ¼ of the wavelength of the electromagnetic wave. It cannot pass through the metal aperture, because the aperture can be regarded as a waveguide whose length is the thickness of the iron mesh. The microwave wavelength of 2.45 GHz is about 12 cm, and a quarter of the wavelength is 3 cm. If other propagation modes in the waveguide are also considered, 1/20 of the 12 cm wavelength, which is 6 mm, is used as the aperture standard, so in the polarization chamber, the main resonant wave with the highest energy can also be suppressed, which is another object of the present invention.

According to the continuous polarization adhesive bonding and transmission apparatus for shoemaking of the present invention, the aperture of the staggered wave reduction columns is not larger than 6 mm when they are connected, and electromagnetic wave shielding sponges and metal braiding are installed around the metal protective plate. Materials such as hoses are used as soft buffer layers to prevent excessive friction during movement. Through the electromagnetic protection plate and its lifting active structure, the apertures of the wave reduction column and the metal of the protection plate are less than 6 mm; and the wave reduction column material includes but not limited to the wave-absorbing materials of metal, carbon, graphite, etc., this is another object of the present invention.

According to the continuous polarization adhesive bonding and transmission apparatus for shoemaking of the present invention, the domino-type electromagnetic protection plate is further fixed to twice the length of the material when the length of the entrance and exit tunnel is fixed. The number of electromagnetic protection layers will be fixed electromagnetic protection plates. Under the dynamic situation, the 2-3 layers are reduced to 1-2 layers. In order to enhance the protection effect, shutter-type electromagnetic protection is added at both ends of the entrance and exit. Moreover, the shutter-type electromagnetic protection is a design of double-drive shaft with a circular scroll-type electromagnetic protective cloth. Among them, the transmission shaft is a synchronous gear design, and its transmission speed can be faster than that of cylinders, hydraulic cylinders, etc., so as to avoid being too late to switch when the production line speed is high. The materials of the electromagnetic protection cloth include but not limited to silver fiber knitted cloth, carbon fiber knitted cloth, EMI electromagnetic protection cloth, etc. The electromagnetic protection cloth is designed with four or more grids in a fence grid shape, which is another object of the present invention.

In view of the above-mentioned major defects in the above-mentioned commonly used adhesives, the inventors had the idea to innovate them. After many years of research, experiments, reviews, corrections, and re-tests, the CONTINUOUS POLARIZATION ADHESIVE BONDING TRANSMISSION DEVICE FOR SHOEMAKING was finally achieved.

DETAILED DESCRIPTION OF PREFERRED EMBODIMENT

Figure 1B:
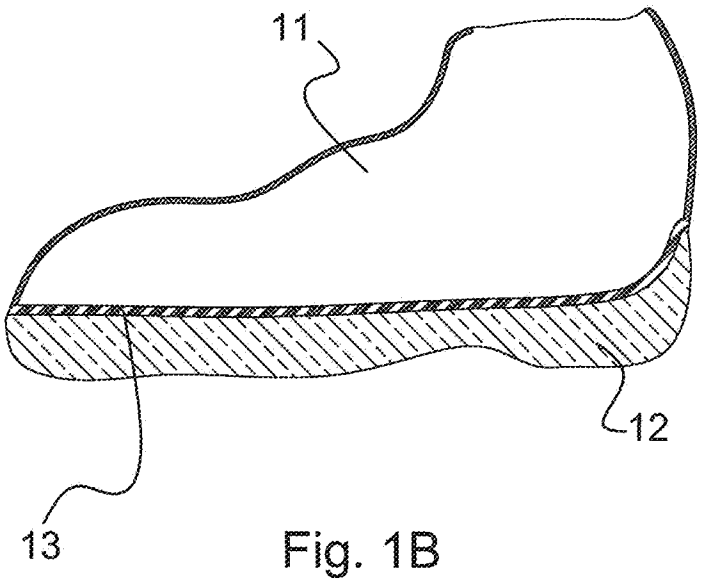
Fig. 1B (Prior Art)
FIG. 1B is a schematic cross-sectional view of a conventional shoe.
Figure 1A:
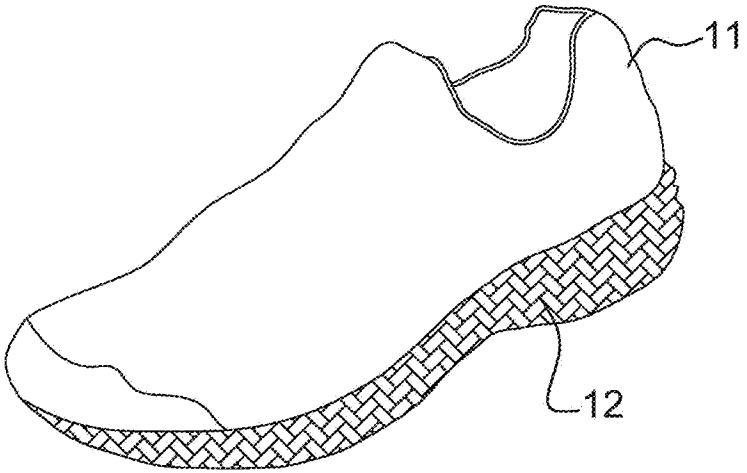
Fig. 1A (Prior Art)
FIG. 1A is a three-dimensional diagram showing a conventional shoe.
Figure 2:
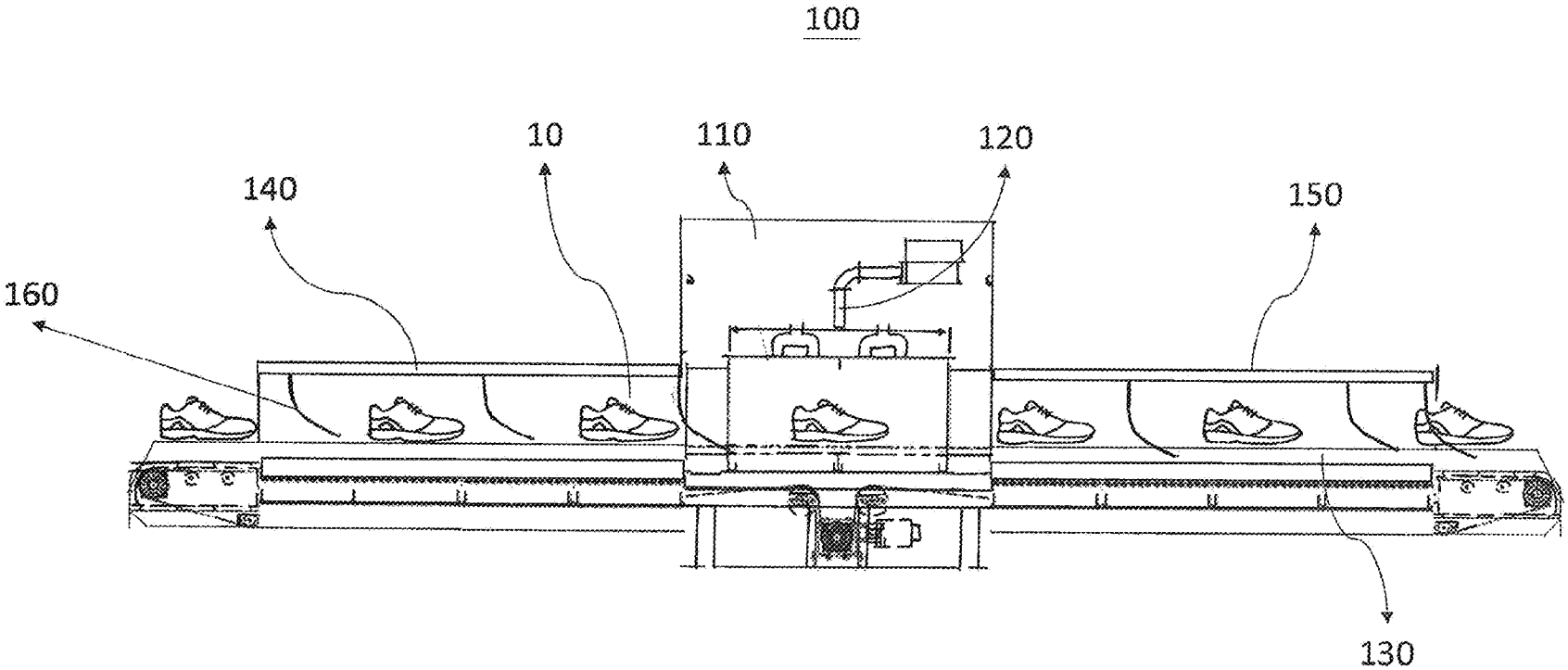
Fig. 2 (Prior Art)
FIG. 2 is a schematic diagram of a common electromagnetic polarization machine production line.
Figure 3:
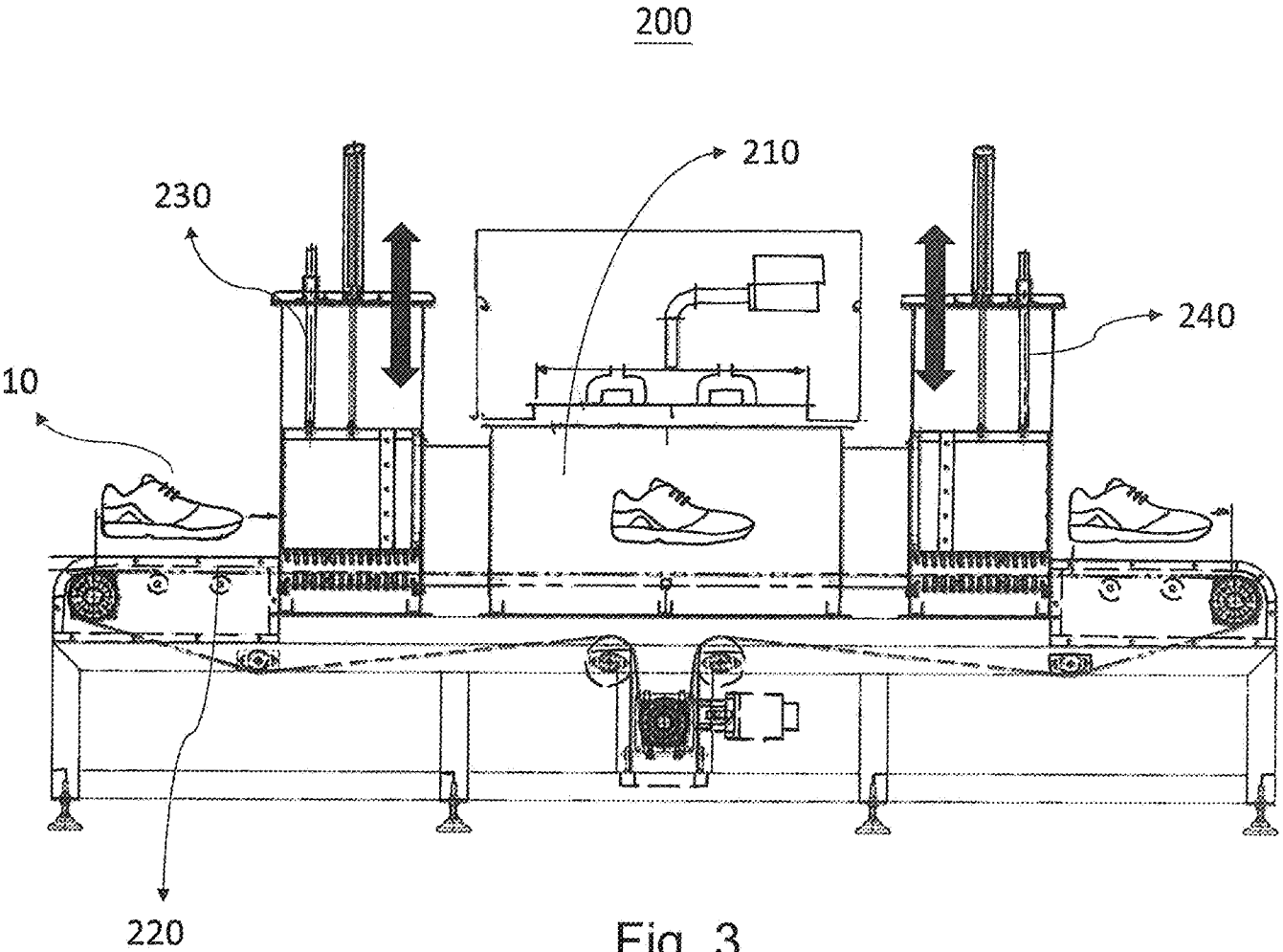
Fig. 3 (Prior Art)
FIG. 3 is a schematic diagram of another common electromagnetic polarization machine production line.
Figure 4:
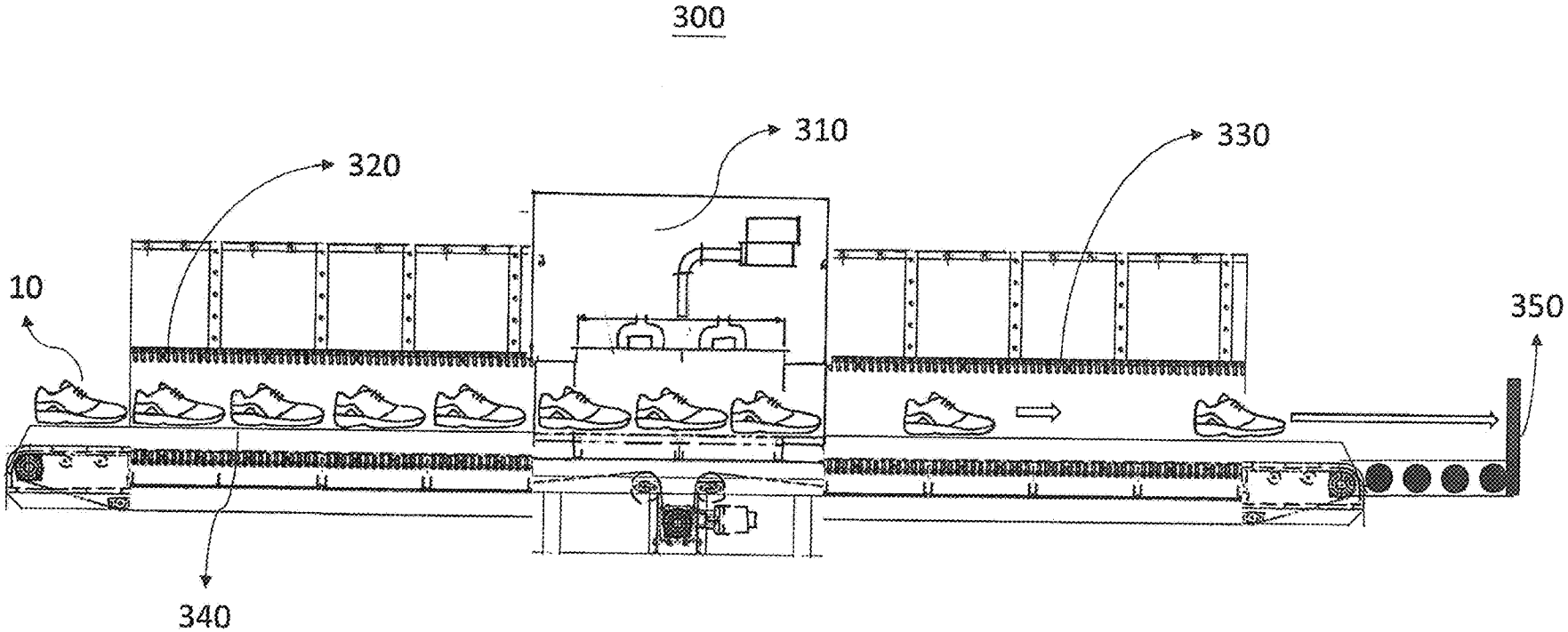
Fig. 4 (Prior Art)
FIG. 4 is a schematic diagram of another common electromagnetic polarization machine production line.
Figure 5:
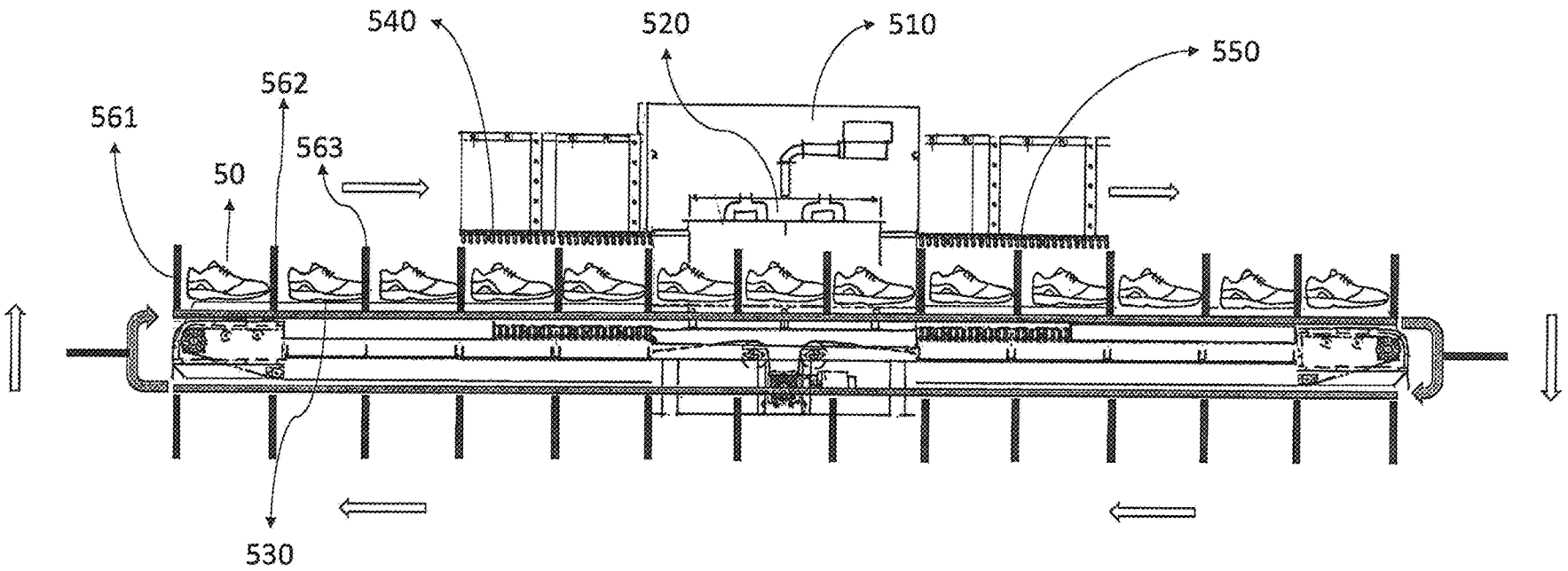
FIG. 5 is a schematic diagram of the electromagnetic polarization machine production line of the continuous polarization adhesive bonding and transmission apparatus for shoemaking according to the present invention.

The continuous polarization adhesive bonding and transmission apparatus for shoemaking of the present invention, as shown in FIG. 5, the electromagnetic polarization machine production line 500 is equipped with a polarization apparatus 520 inside the polarization chamber 510. A conveyor belt 530 is provided below the polarization chamber 510. The conveyor belt 530 is circular and is mainly used to carry the shoe body 50 (including soles and vamp) to the bottom of the polarization chamber 510, after being polarized by the polarization apparatus 520, and then transport the polarized shoe body 50 to the rear-end operation area.

As shown in FIG. 5, the entry side and the exit side of the polarization chamber 510 are each provided with a wave blocking tunnel 540/550, and the conveyor belt 530 passes through said wave blocking tunnel 540, 550. The conveyor belt 530 is also provided with spaced electromagnetic protection plates 561, 562, 563 . . . , each electromagnetic protection plate 561, 562, 563 . . . is upright on the conveyor belt 530, and the shoe body 50 on the conveyor belt 530 is located between each two electromagnetic protection plates 561, 562, 563 . . . , since the upper ends of the electromagnetic protection plates 561, 562, 563 . . . are open, not only the production capacity can be effectively increased, but also the opening height can be unrestricted and can be applied to riding boots, boots, etc., Moreover, the wave blocking tunnels 540 and 550 are short and have low construction cost. Taking the polarization time as 20 seconds and the production line speed as 6 meters per minute as an example, then approximately 15 pairs of shoes can be polarized per minute, and the cooling time is 8 seconds.

Figure 6:
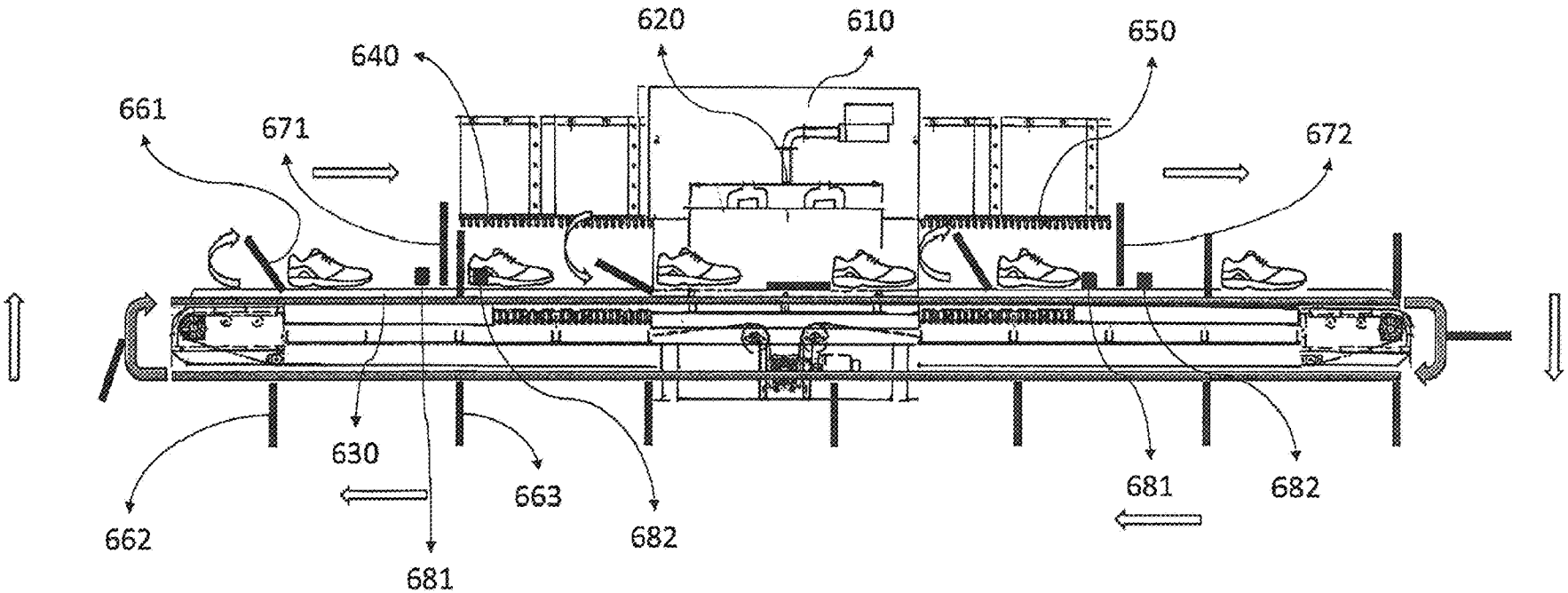
FIG. 6 is a schematic diagram of the second embodiment of the electromagnetic polarization machine production line for the continuous polarization adhesive bonding and transmission apparatus for shoemaking according to the present invention.

Please refer to FIG. 6, it is another embodiment of the continuously polarized adhesive bonding and transmission apparatus for shoemaking of the present invention. As shown in this figure, the electromagnetic polarization machine production line 600 is also installed inside the polarization chamber 610. In the polarization apparatus 620, a conveyor belt 630 is provided below the polarization chamber 610. A wave blocking tunnel 640 and 650 are respectively provided on the entry and exit sides of the polarization chamber 610. The conveyor belt 630 passes through the wave blocking tunnel 640 and 650. 650. The difference is that this conveyor belt 630 is a double-track conveyor belt, and the electromagnetic shielding plates provided on the conveyor belt 630 are domino-type of electromagnetic shielding plates 661, 662, 663 . . . , and at the entrances of the wave blocking tunnels 640 and 650 are respectively a shutter-type electromagnetic protection plate 671, 672, and at the exit and the inner point of the shutter-type electromagnetic protection plate 671, 672 are respectively provided with a detection opening switch 681 and a detection closing switch 682.

Figure 7:
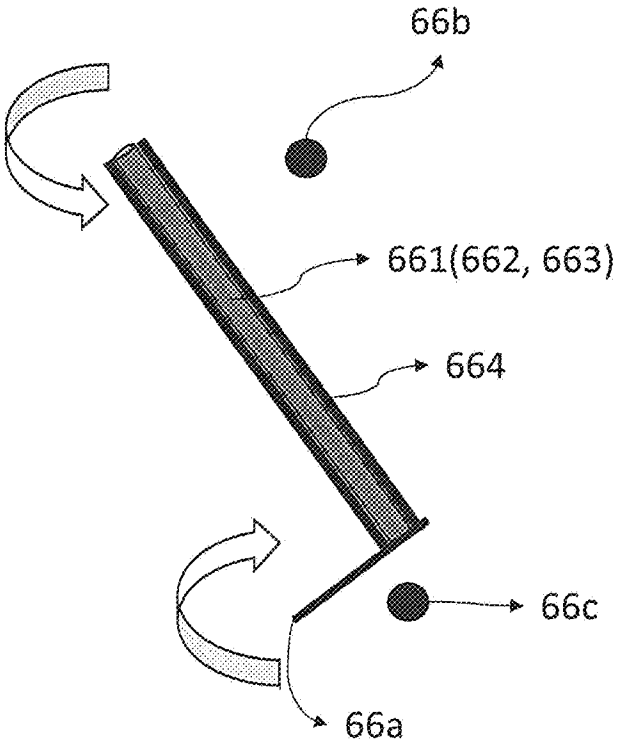
FIG. 7 is a side view of the domino-type electromagnetic protection plate of the continuously polarization adhesive bonding and transmission apparatus for shoemaking according to the present invention.

Please refer to FIG. 7, the domino type electromagnetic protection plates 661, 662, 663 . . . are covered with hoses 664 of metal, carbon fiber, EMI sponge . . . etc. on their outer periphery, and the lower ends on both sides are pivoted on the outer rail shaft of the conveyor belt 630, and its lower part is connected to a bottom gate 66*a* that is almost perpendicular to it. An upper roller 66*b* is provided above the wave-blocking tunnels 640 and 650, and a lower roller 66*c* is provided below the conveyor belt 630; thereby, when the domino-type electromagnetic protection plates 661, 662, 663 . . . are driven by the conveyor belt 630 and advance to the upper part thereof and touch the upper roller 66*b*, they will fall down; while the bottom gate plate 66*a* touches the lower roller 66*c*, it is in an upright position.

Figure 8:
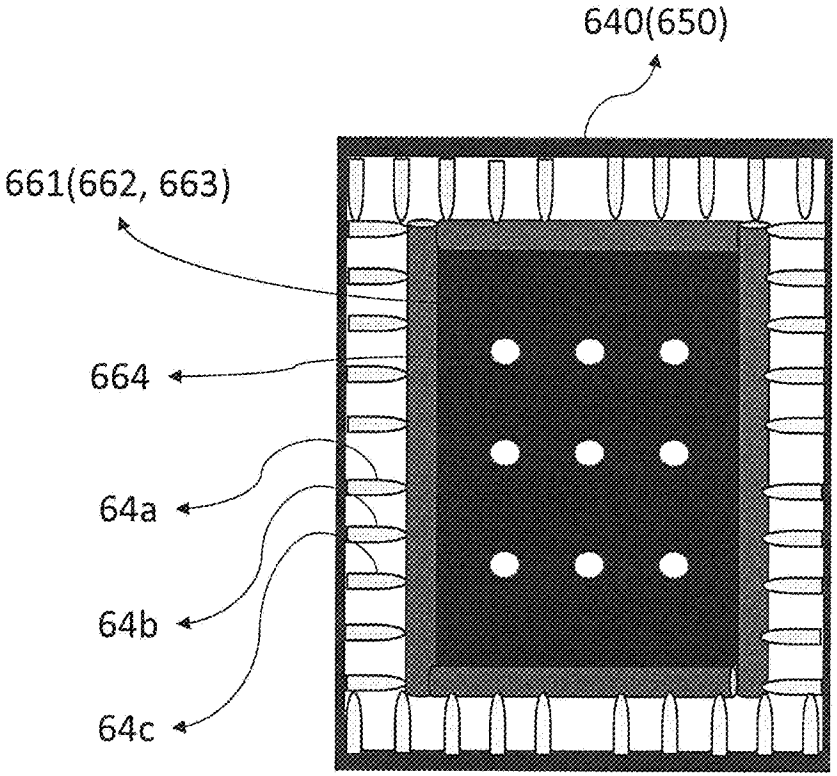
FIG. 8 is a schematic plan view of the wave blocking tunnel and the electromagnetic protection plate of the continuously polarization adhesive bonding and transmission apparatus for shoemaking according the present invention.

Referring again to FIG. 8, it can be seen that since the conveyor belt 630 runs through the wave blocking tunnels 640 and 650, the wave reducing columns 64*a*, 64*b*, 64*c* . . . preset inside the wave blocking tunnels 640 and 650 surround the wave blocking tunnels. When the domino-type electromagnetic protection plates 661, 662, 663 . . . are erected on the inner sides of the tunnels 640 and 650, they form an almost airtight cross-section with the surrounding wave reduction columns 64*a*, 64*b*, 64*c* . . . to achieve a condition of absolutely preventing polarized waves from leaking out.

Figure 9:
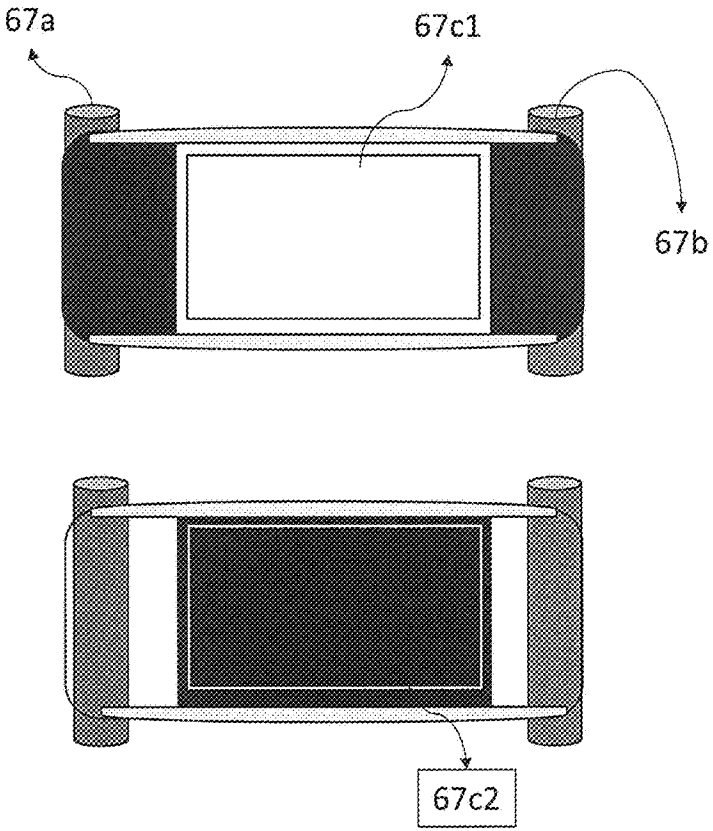
FIG. 9 is a schematic diagram of the shutter-type electromagnetic protection plate of the continuous polarization adhesive bonding and transmission apparatus for shoemaking according to the present invention.
Figure 9:
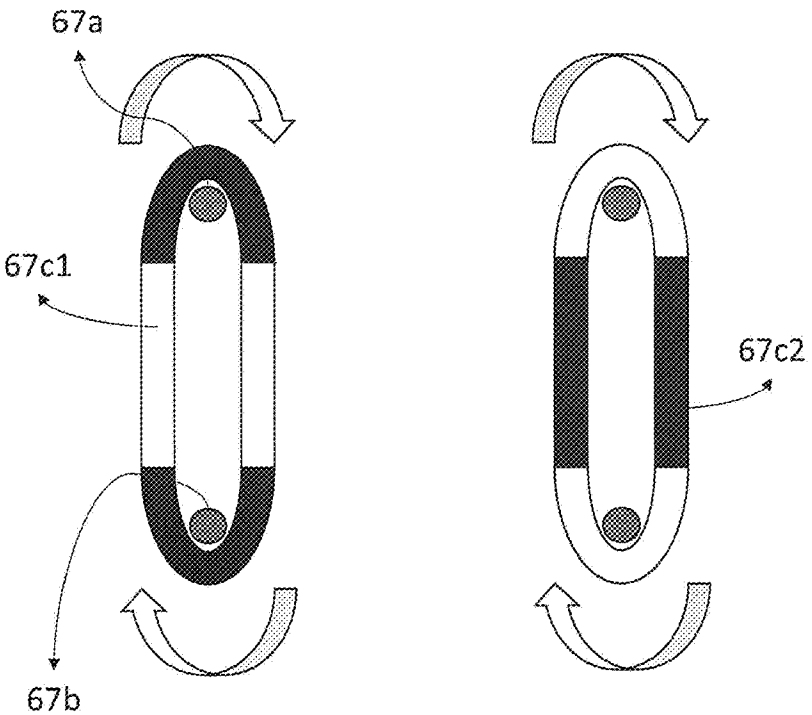

Please refer to FIG. 9, the shutter type electromagnetic protection plates 671, 672 are arranged with a shutter cloth 67*c* between the two gear track shafts 67*a*, 67*b*. The shutter cloth 67*c* can be divided into a hollow surface 67*cl* and a solid surface 67*c*2. When the shutter cloth 67*c* turns to the hollow surface 67*c*1, the shutter is in an open state, allowing the shoe body to pass; when the shutter cloth 67*c* turns to the solid surface 67*c*2, the shutter is in a closed state, which can prevent the leakage of polarized waves.

Figure 10:
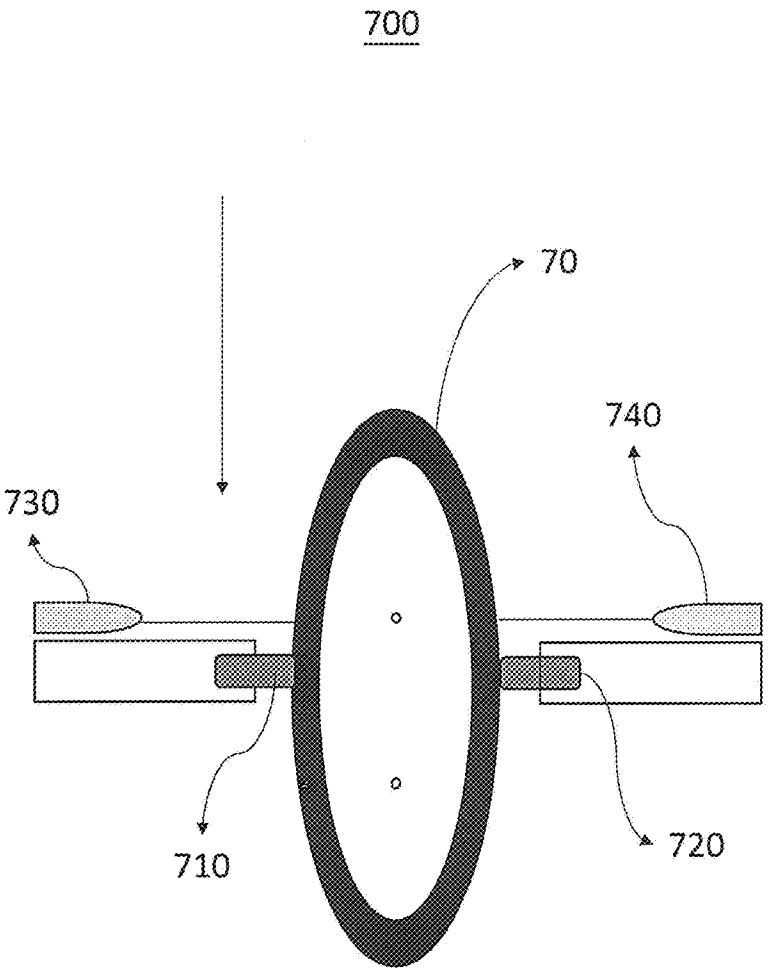
FIG. 10 is a schematic diagram of the operation of the automatic scanner of the continuous polarization adhesive bonding and transmission apparatus for shoemaking according to the present invention.
Figure 10:
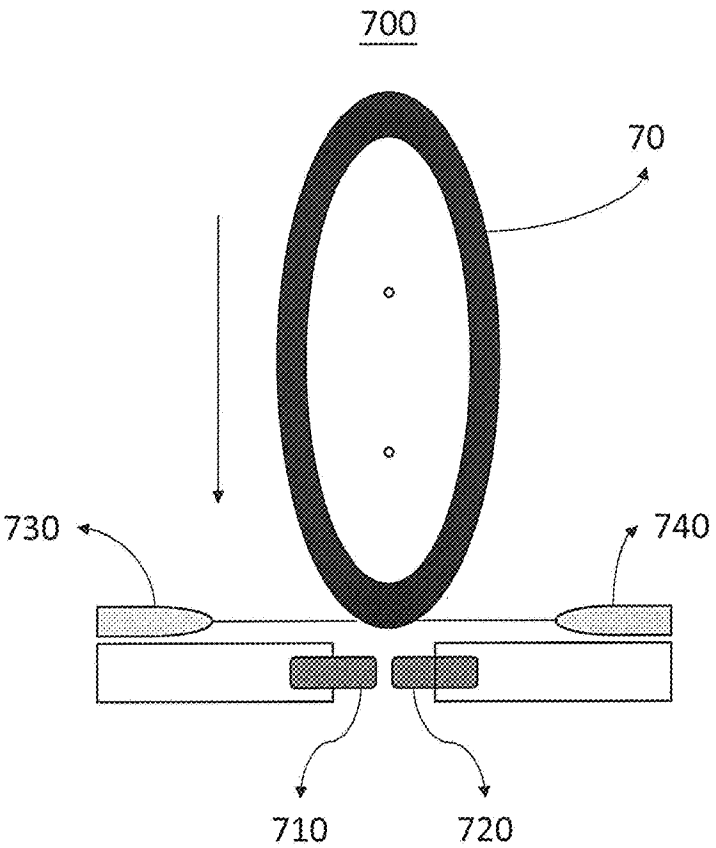

Please refer to FIG. 10. The continuous polarization adhesive bonding transmission device for shoemaking of the present invention can be installed with an automatic glue sweeper 700 at the front end of the electromagnetic polarization machine production line to remove the residual glue on the shoe body. The automatic glue sweeper 700 is equipped with a brush wheel 710, 720 on both sides of the conveyor belt, and is respectively equipped with an infrared range finder 730, 740. The infrared range finder 730, 740 can be used to detect the sole of the shoe 70, thereby adjusting the distance between the two brushing wheels 710 and 720, so that when the sole 70 passes between the two brushing wheels 710 and 720, the two brushing wheels 710 and 720 can be used to instantly brush away the residual glue around the sole 70 from top to bottom.

Since the production capacity of the continuous electromagnetic polarization machine is determined by the material grid distance, linear speed and polarization chamber length, in a condition of without changing the production line speed and polarization chamber length, the production capacity for the materials of continuously arranged and grid arranged will differ by two times. And when the speed of the chamber and production line remains unchanged, if the production capacity can be doubled, it means that the depreciation and amortization costs, electricity bills, etc. of the microwave magnetron will be reduced by ½. In order to improve the continuous arrangement and mass production, another embodiment of the continuously polarization adhesive transmission apparatus for shoemaking of the present invention is produced.

Figure 11:
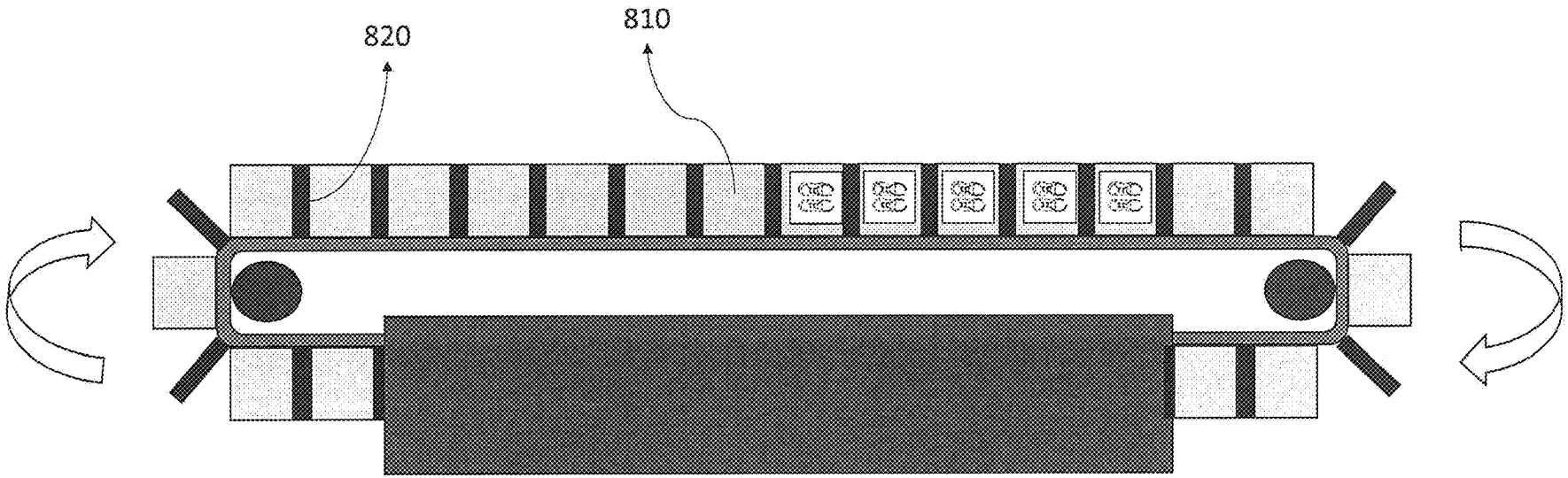
FIG. 11 is a schematic diagram of the cantilevered turntable conveyor belt of the continuous polarization adhesive bonding and transmission apparatus for shoemaking according to the present invention.
Figure 12:
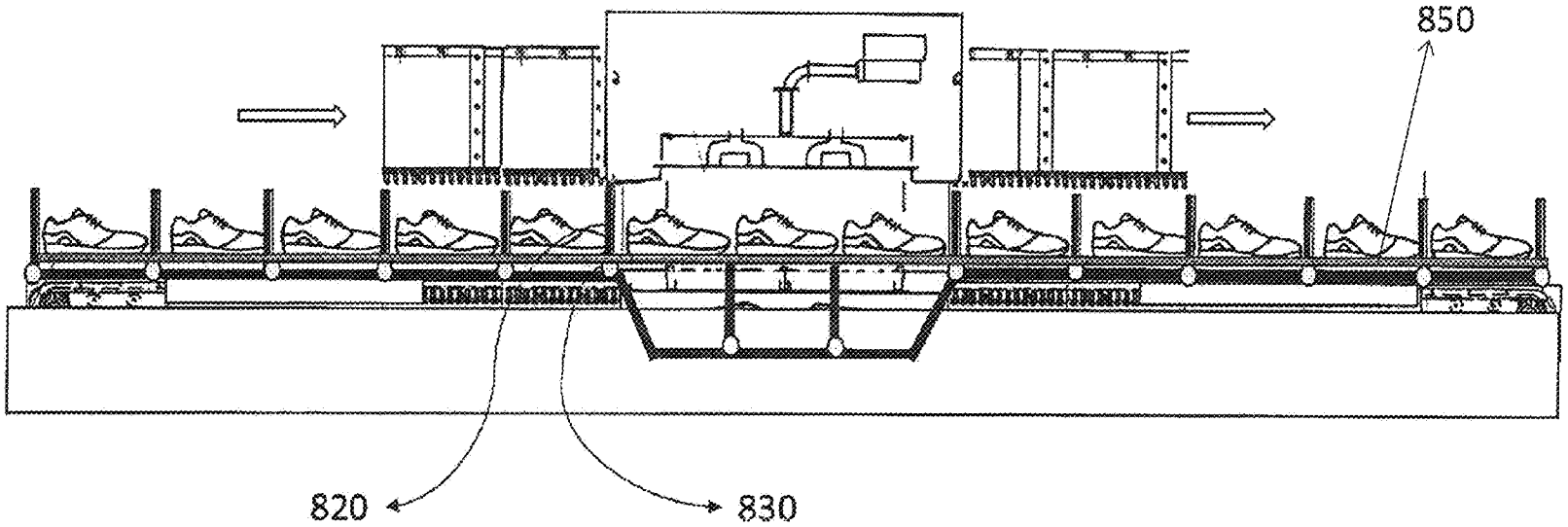
FIG. 12 is a schematic diagram of the electromagnetic polarization machine production line of the continuous polarization adhesive bonding and transmission apparatus for shoemaking according to the second embodiment of the present invention.
Figure 13:
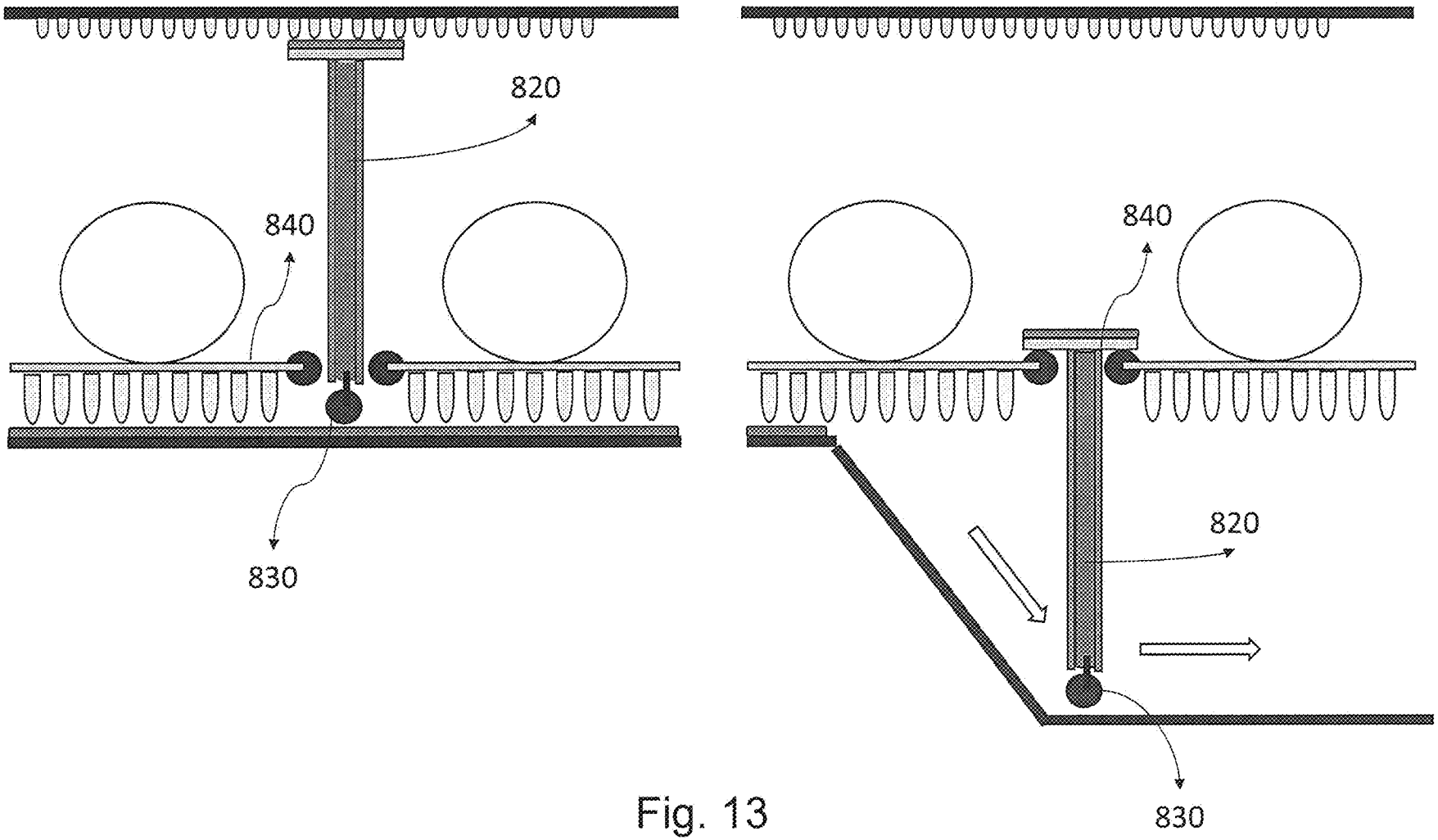
FIG. 13 is a partial enlarged schematic diagram of the third embodiment of the electromagnetic polarization machine production line schematic diagram of the continuous polarization adhesive bonding and transmission apparatus for shoemaking according to the present invention.

Please refer to FIG. 11, which is an another embodiment of the continuous polarization adhesive bonding and transmission apparatus for shoemaking of the present invention. As shown in this figure, the conveyor belt is a cantilevered turntable conveyor belt 810, and there is no mechanical facility below the conveyor belt 810, so the electromagnetic protection plate 820 can be improved and designed to rise and fall vertically. As shown in FIGS. 12 and 13, the electromagnetic protection plate 820 remains in a rising state when entering and exiting the tunnel, and a transmission wheel 830 is installed below the electromagnetic protection plate 820 so that it can slide smoothly. When the electromagnetic protection plate 820 reaches the bottom of the polarization chamber, it remains in a rising state, the plate 820 is then lowered, and the opening between the material pallets 850 is covered with a stainless steel plate 840 above the electromagnetic protection plate 820. Where in, the EMI radiation-proof sponge can prevent metal from rubbing against each other when the machine vibrates, and can also enhance the microwave suppression effect. Therefore, it is composed of vertical lifting electromagnetic protection plate plus cantilever turntable conveyor belt plus microwave descending chamber. In this way, the materials can be continuously arranged. If the polarization time is 20 seconds, the polarization chamber length is 2 meters, and the working hours are 8 hours per day, the production capacity can reach 7200 pairs per day. If the chamber length of a microwave oven used in the general food industry is 4 meters, the production capacity can reach 14,400 pairs per day, and the effect is remarkable.

In addition, the large-opening continuous polarization chamber is a problem that the industry urgently needs to overcome. If the opening is 5-10 cm, the material will be limited, and it can only be used for drying smaller materials such as powder, dried fruit . . . etc. However, when central kitchens such as Costco, campuses, military camps, etc. use microwaves to defrost beef pieces, they can only use single-batch microwave ovens because the height of the pieces of meat is very high and inconsistent, which is inefficient and is not easy to promote in other industries. If the problem of opening height can be effectively overcome, its technical applications will include but not be limited to: food industry, shoe industry, papermaking, wood furniture, environmental recycling, painting . . . and other industries.

The continuous polarized adhesive bonding and transmission apparatus for shoemaking of the present invention, when implemented, has the following detailed constructions, which can be in the form listed below to improve the overall performance, including:

(1). Since the polarization wave system periodically intersects and will form hot and cold stratification, the simulation of the polarization wave mode is very important. Therefore, lengthening the polarization chamber can increase the polarization time while the conveyor belt speed and production capacity remain unchanged. If the polarization is uneven, the polarization chamber can also be lengthened to increase the number of cycles to improve.

(2). The thickness of the adhesive will affect the polarization effect. All materials will absorb polarization waves to some extent. In addition to absorption, another key factor is the thickness of the material. The thicker the material, the greater the dielectric loss and the faster the temperature rises. However, the thickness of foam soles is 20 mm minus 50 mm, but the adhesive layer is only 0.1 mm minus 0.2 mm, so a polarizing absorber is needed to make the adhesive layer heat up much faster than the foam sole.

(3). The height of the polarization chamber will also affect the uniformity of polarization. The higher the height of the chamber, the more difficult it will be for the polarization wave to have a uniform mode. If it is to be used in high-top shoes such as riding boots and long boots in the future, the magnetic field can be used. The control tubes can be placed on both sides of the chamber in a staggered arrangement to lengthen the chamber, speed up the line speed, and feed materials with a single shoe.

(4). The entrance and exit openings of wave-blocking tunnels can be designed with wave-reducing columns.

(5). The casing weld bead is equipped with a design of metal hose double-layer jacket.

(6). Microwave protection materials can be silver fiber knitted fabric, carbon fiber knitted fabric, or radiation shielding sponge.

(7). Folding edges, welding beads, and all sharp corners must be rounded, and there must be no metal burrs.

(8). The magnetron is water-cooled under continuous operation, and the power is 600 W, 1 KW, 3 KW. It has low power, multiple outputs and high efficiency.

(9). Set up automatic leak detection and shutdown system.

(10). Polarization chamber camera: Use the screen to monitor polarization conditions.

(11). Install anti-fool devices, and two power-off devices must be installed when the warehouse door opens accidentally to prevent one of them from malfunctioning.

(12). If the conveyor belt use an anti-pulley drive, which may cause slippage when driven by multiple fixtures. If the set production line speed does not match the actual speed, the polarization time will be faster and slower, the yield rate will be affected, the gear synchronous transmission can be installed to improve it.

(13). The clamp currently used is POM, which is not strong enough and will block waves. The teeth may slip after being disassembled several times, and the screws are made of metal and are prone to wave interference. The above situation can be improved by using zirconia that does not absorb waves and is used in high-strength applications such as automobile bearing gears and cutting tools.

(14). If the clamp cannot be disassembled and assembled quickly enough and the side pressure is not enough, a reusable vacuum bag can also be used for continuous operation, but the bag must be thickened to avoid rewinding. Moreover, the vacuum bag will pressurize the entire shoe vamp, and the rear root of the shoe last must fit snugly with the shoe vamp to avoid wrinkles there after heating.

(15). The bottom mold can be made of low water absorption and low wave absorption materials such as EVA and TPR to avoid overheating during continuous operation.

(16). The support base plate is currently made of Melamine which will overheat during continuous operation. It can be replaced by PP, PEEK or zirconia.

(17). If the last is made of plastic, it has to be confirmed by the manufacturer. It is suggested to use talcum powder and calcium carbonate highly filled lightweight materials to improve the heat protection effect.

(18). To position the toe and heel, a PUR dispensing machine can be used to place glue at a single point on the toe and heel before fitting and positioning. This can avoid positioning when the clamp or vacuum bag is pressurized. The pulling force of single-point glue dispensing is very small. If it is stuck crookedly, it can be unplugged and re-attached. After the glue is fixed, the clamp can be put in to speed up the disassembly and assembly. The amount of glue should not be too thick to avoid glue overflow.

(19). To prevent from leakage of electromagnetic wave, place a Gauss meter 5 cm from the entrance and exit, turn on the "non-interruptible" microwave and allow the mold to enter and exit normally at linear speed for 3 minutes, and the detection dose does not exceed 4 m W/cm2 (the international standard is 5 mW/cm2).

The characteristics of the continuous polarization bonding and transmission apparatus for shoemaking of the present invention can be summarized as follows:

1. Considering the limitations of the microwave suppression structure of the enhanced tunnel, the microwave suppression design direction has shifted from tunnel enhancement to focus on the material itself. If the material is not infinitely long, there may be gaps between the materials, so this gap can be used to install a microwave suppression structure. In this way, the size of the suppressor can be consistent with the size of the material, forming a continuous dynamic gate microwave suppression structure.

2. Microwaves can be blocked by the movable electromagnetic protective plate moving along with the material. As long as the size of the electromagnetic protective plate increases as the material increases, it can be increased material size, microwave oven opening size without changing the microwave suppression structure of the chamber and the length of the chamber tunnel.

3. In order to prevent the electromagnetic protection plate from entering the microwave chamber in the rising state and affecting the microwave mode distribution in the chamber, the domino type electromagnetic protection plate of the present invention rises before entering the entrance tunnel, descends before entering the microwave chamber, and rises before leaving the microwave chamber, such that the above situation can be improved.

4. There is a gap between the chamber wall of the entrance and exit tunnel and the electromagnetic protection plate. It is necessary to add a metal cylinder arrangement as a microwave suppression construction. The above construction and the construction of the electromagnetic protection plate itself must consider the shielding effect. The shielding effect is generally called the "electrostatic" shielding effect. For electromagnetic waves, the skin effect and skin depth must also be considered. That is to say, when an electromagnetic wave hits a metal plate, most of the energy is reflected, and a small part of the energy enters the metal. The intensity of the electromagnetic wave will decay exponentially with the depth of the metal (converted into a current inside the metal). When the metal layer is too thin, the electromagnetic waves will penetrate the metal layer and continue to propagate. For the same metal material, the higher the frequency of the electromagnetic wave, the faster it attenuates. For the 2.45 GHz of the electromagnetic wave used in microwave ovens, the skin depth of metallic iron is less than 1 micron, so the metal thickness of the chamber wall and electromagnetic protection plate needs to be greater than 1 micron.

5. According to experiments, as long as the metal aperture is less than ¼ of the wavelength of the electromagnetic wave, the electromagnetic wave cannot pass through the metal aperture, because the aperture can be regarded as a waveguide with a tube length equal to the thickness of the iron mesh. The microwave wavelength of 2.45 GHz is about 12 centimeters, and a quarter of the wavelength is 3 centimeters. If other propagation modes in the waveguide are also considered, 1/20 of the 12 centimeters wavelength, which is 6 millimeters, is used as the aperture standard. In this way, the main resonant wave with the highest energy in the microwave oven can also be suppressed.

6. Multiple metal cylinders (herewith referred to as wave reduction columns) are designed to intersect with each other between the electromagnetic protection plate and the tunnel chamber wall. The aperture is no larger than 6 mm during the intersection. Electromagnetic wave shielding sponges and metal braiding are installed around the metal protection plate. Materials such as hoses serve as soft buffer layers to prevent excessive friction during movement. The metal apertures of the wave reduction column and the protective plate are both less than 6 mm. The materials of the wave reduction column include but are not limited to metal, carbon, graphite . . . and other wave-absorbing materials.

7. The shutter type electromagnetic protection is combined with the domino type electromagnetic protection plate. When the length of the entrance and exit tunnel is fixed to twice the length of the material, the number of electromagnetic protection layers will be reduced from 2-3 layers to 1-2 layers under the dynamic conditions of the fixed electromagnetic protection plate. The shutter type electromagnetic protection is constructed with a double drive shaft and a circular reel type electromagnetic protection cloth. Among them, the transmission shaft is a constructive of synchronous gear, and its transmission speed can be faster than that of cylinders, hydraulic cylinders, etc., to avoid being too late to switch when the production line speed is high. The materials of electromagnetic protection cloth include but are not limited to silver fiber knitted cloth, carbon fiber knitted cloth, EMI electromagnetic protection cloth, etc. The electromagnetic protection cloth is constructed with four or more grids like a fence.

Based on the above, the continuous polarization adhesive bonding and transmission apparatus for shoemaking of the present invention does have an unprecedented innovative structure. It has not been seen in any publications, and there is no product made by any similar method on the market, therefore, there should be no doubt about its novelty. In addition, the unique features and functions of the present invention are far beyond what is conventionally used, so it is indeed more progressive than conventional practice. It complies with the conditions for allowable patent applications.

It should be noted that the above are preferred specific embodiments of the present invention. If changes are made according to the concept of the present invention, the functional effects thereof will not exceed the spirit covered by the description and illustrations. All should be stated clearly within the scope of the present invention.

What is claimed is:

1. A continuous polarization adhesive bonding and transmission apparatus for shoemaking, which is provided with a polarization chamber, a polarization device is provided inside said polarization chamber, and a conveyor belt is provided below the polarization chamber, said conveyor belt can transport a material that passes through the polarization chamber and then polarized by the polarization device; there is a wave blocking tunnel on an entry side and an exit side below the polarization chamber, the conveyor belt runs through the wave blocking tunnel on the entry side, a chamber tunnel and the exit side of the wave-blocking tunnel; characterized in that: the inner wall of the wave-blocking tunnel is provided with wave-reducing columns, and the conveyor belt is provided with spaced electromagnetic protection plates, each material transported by the conveyor belt is between two electromagnetic protection plates;

wherein each electromagnetic protection plate is a domino-type electromagnetic protection plate, and wherein the lower end of the domino-type electromagnetic protection plate is connected to a bottom gate plate that is almost perpendicular to it; an upper roller is provided above the wave blocking tunnel, and a lower roller is provided below the conveyor belt; thereby, when the domino-type electromagnetic protection plate is driven by the conveyor belt and advances to touch the upper roller, it will fall down, when its bottom gate plate touches the lower roller, it appears in an upright state.

2. The continuous polarization adhesive bonding and transmission apparatus for shoemaking as claimed in claim 1, wherein each electromagnetic protection plate is upright on the conveyor belt.

3. The continuous polarization adhesive bonding and transmission apparatus for shoemaking as claimed in claim 1, wherein the entry side and exit side of the polarization chamber are each provided with a shutter-type electromagnetic protection plate, inner and outer points of the protection plate are respectively provided with a detection on switch and a detection off switch.

4. The continuous polarization adhesive bonding and transmission apparatus for shoemaking as claimed in claim 3, wherein the shutter-type electromagnetic protection plate is provided with a shutter cloth between two gear-type track shafts, and the shutter cloth can be divided into two parts of a hollow surface part and a solid surface part; when the shutter cloth is turned to the solid surface part, the shutter-type electromagnetic protection plate is closed, when the shutter cloth is turned to the hollow surface part, the shutter-type electromagnetic protection plate is opened.

5. The continuous polarization adhesive bonding and transmission apparatus for shoemaking as claimed in claim 1, wherein an automatic glue sweeper that can remove residual glue on a shoe body is provided, the automatic glue sweeper is installed with a brushing wheel on both sides of the conveyor belt, and an infrared rangefinder for detecting the peripheral position of a sole is provided, thereby adjusting a distance between the two brushing wheels so that when the sole passes between the two brushing wheels, the brushing wheels shall brush off the residual glue around the sole from top to bottom.

6. The continuous polarization adhesive bonding and transmission apparatus for shoemaking as claimed in claim 1, wherein a distance between the wave reduction columns is less than 6 mm.

7. The continuous polarization adhesive bonding and transmission apparatus for shoemaking as claimed in claim 1, wherein the outer periphery of the domino-type electromagnetic protection plate is covered with hoses of metal, carbon fiber or electromagnetic interference (EMI) sponges.

8. A continuous polarization adhesive bonding and transmission apparatus for shoemaking, which is provided with a polarization chamber, a polarization device is provided inside said polarization chamber, and a conveyor belt is provided below the polarization chamber, said conveyor belt can transport a material that passes through the polarization chamber and then polarized by the polarization device; there is a wave blocking tunnel on an entry side and an exit side below the polarization chamber, the conveyor belt runs through the wave blocking tunnel on the entry side, a chamber tunnel and the exit side of the wave-blocking tunnel; characterized in that: the inner wall of the wave-blocking tunnel is provided with wave-reducing columns, and the conveyor belt is provided with spaced electromagnetic protection plates, each material transported by the conveyor belt is between two electromagnetic protection plates;

wherein each electromagnetic protection plate is a domino-type electromagnetic protection plate, and wherein the entry side and exit side of the polarization chamber are each provided with a shutter-type electromagnetic protection plate, inner and outer points of the protection plate are respectively provided with a detection on switch and a detection off switch.

9. The continuous polarization adhesive bonding and transmission apparatus for shoemaking according to claim 8, wherein the lower end of the domino-type electromagnetic protection plate is connected to a bottom gate plate that is almost perpendicular to it; an upper roller is provided above the wave blocking tunnel, and a lower roller is provided below the conveyor belt; thereby, when the domino-type electromagnetic protection plate is driven by the conveyor belt and advances to touch the upper roller, it will fall down, when its bottom gate plate touches the lower roller, it appears in an upright state.

10. The continuous polarization adhesive bonding and transmission apparatus for shoemaking according to claim 8, wherein the shutter-type electromagnetic protection plate is provided with a shutter cloth between two gear-type track shafts, and the shutter cloth can be divided into two parts of a hollow surface part and a solid surface part; when the shutter cloth is turned to the solid surface part, the shutter-type electromagnetic protection plate is closed, when the shutter cloth is turned to the hollow surface part, the shutter-type electromagnetic protection plate is opened.

11. The continuous polarization adhesive bonding and transmission apparatus for shoemaking according to claim 8, wherein said conveyor belt can be a cantilevered turntable conveyor belt to keep each electromagnetic protection plate in a rising state when entering and exiting the wave blocking tunnel; a transmission wheel is installed below an electromagnetic protective plate so that it can slide smoothly; when it reaches the inside of the polarization chamber, the electromagnetic protective plate descends, and a stainless steel plate is used to cover an opening between material pallets above the electromagnetic protective plate.

12. The continuous polarization adhesive bonding and transmission apparatus for shoemaking as claimed in claim 8, wherein a distance between the wave reduction columns is less than 6 mm.

13. The continuous polarization adhesive bonding and transmission apparatus for shoemaking as claimed in claim 8, wherein the outer periphery of the domino-type electromagnetic protection plate is covered with hoses of metal, carbon fiber or electromagnetic interference (EMI) sponges.

14. A continuous polarization adhesive bonding and transmission apparatus for shoemaking, which is provided with a polarization chamber, a polarization device is provided inside said polarization chamber, and a conveyor belt is provided below the polarization chamber, said conveyor belt can transport a material that passes through the polarization chamber and then polarized by the polarization device; there is a wave blocking tunnel on an entry side and an exit side below the polarization chamber, the conveyor belt runs through the wave blocking tunnel on the entry side, a chamber tunnel and the exit side of the wave-blocking tunnel; characterized in that: the inner wall of the wave-blocking tunnel is provided with wave-reducing columns, and the conveyor belt is provided with spaced electromagnetic protection plates, each material transported by the conveyor belt is between two electromagnetic protection plates;

wherein an automatic glue sweeper that can remove residual glue on a shoe body is provided, the automatic glue sweeper is installed with a brushing wheel on both sides of the conveyor belt, and an infrared rangefinder for detecting the peripheral position of a sole is provided, thereby adjusting a distance between the two brushing wheels so that when the sole passes between the two brushing wheels, the brushing wheels shall brush off the residual glue around the sole from top to bottom.

* * * * *